US012487053B1

(12) United States Patent
Chen

(10) Patent No.: US 12,487,053 B1
(45) Date of Patent: Dec. 2, 2025

(54) GUN LIGHT THAT IS EASY TO REPLACE WITH BATTERIES

(71) Applicant: Qijian Chen, Shenzhen (CN)

(72) Inventor: Qijian Chen, Shenzhen (CN)

( * ) Notice: Subject to any disclaimer, the term of this patent is extended or adjusted under 35 U.S.C. 154(b) by 0 days.

(21) Appl. No.: 19/288,370

(22) Filed: Aug. 1, 2025

(51) Int. Cl.
*F41G 1/35* (2006.01)
*F41G 11/00* (2006.01)

(52) U.S. Cl.
CPC ..... *F41G 1/35* (2013.01); *F41G 11/004* (2013.01)

(58) Field of Classification Search
CPC ..... F41G 1/35
USPC ..... 42/146
See application file for complete search history.

(56) References Cited

U.S. PATENT DOCUMENTS

| | | | | |
|---|---|---|---|---|
| 11,118,864 | B2 * | 9/2021 | Galli | F41G 1/35 |
| 11,608,970 | B2 * | 3/2023 | Jiang | F41G 1/35 |
| 2021/0140743 | A1 * | 5/2021 | Chen | F41G 11/003 |
| 2022/0003393 | A1 * | 1/2022 | Starr | F21V 23/04 |

* cited by examiner

*Primary Examiner* — Reginald S Tillman, Jr.
(74) *Attorney, Agent, or Firm* — JEEN IP LAW, LLC

(57) ABSTRACT

A gun light that facilitates battery replacement is provided, which includes a housing, a light-emitting module, a seat module, and a fixing mechanism. The housing is provided with a battery compartment, and the battery compartment is slidably fitted with a battery module; one side of the light-emitting module is rotatably connected to one end of the housing, and the other side of the light-emitting module is provided with a light-emitting locking groove. The seat module is connected to the other end of the housing. The fixing mechanism includes a locking component, which includes a locking elastic sheet and a light-emitting locking rod. The locking elastic sheet is fixedly connected to the housing. This application has the effect of reducing the risk of accidental contact causing the battery module to detach from the housing.

10 Claims, 15 Drawing Sheets

GUN LIGHT THAT IS EASY TO REPLACE WITH BATTERIES

TECHNICAL FIELD

The present disclosure relates to the field of gun light technologies, and in particular, to a gun light that is easy to replace with batteries.

BACKGROUND

In the field of tactical equipment, gun light, as a key auxiliary component of weapon systems, needs to meet the requirements of high-intensity and real-time response. Its core functions include target illumination in low light environments, tactical deterrence, and synergy with optical sights. When the gun light needs to be used for a plurality of hours to tens of hours in a single mission, it is prone to rapid battery depletion in continuous high brightness mode. Thus, when the continuous use time is too long, a user usually quickly replaces the battery during task gaps or emergency situations.

The existing gun lights that are easy to replace batteries generally include a housing and a battery component. The battery component includes a battery holder, a battery module, a pressing rod, a reset spring, and a clamping block. The battery holder slides and fits inside the housing, the battery module is set on the battery holder, and the pressing rod slides and fits on the housing. One end of the reset spring is fixedly connected to the pressing rod, and the other end of the reset spring is fixedly connected to the housing. The clamping block is fixedly set on the pressing rod. When the battery holder is connected to the housing, the clamping block is clamped and fits with the battery holder. When the gun light needs to replace the battery module, the pressing rod is pressed, and the pressing rod drives the clamping block to move away from the housing, so that the clamping block is disconnected from the housing, thereby releasing a fixed connection between the battery holder and the housing, and then the user pulls out the battery holder to complete the battery replacement.

Regarding the related technologies mentioned above, the pressing rod of the gun light is prone to accidental contact by the user or debris during use, which can cause the fixed connection between the battery holder and the housing to be released, thereby resulting in the battery holder slipping and causing the power supply of the gun light to be cut off, thus affecting a normal use of the gun light.

SUMMARY

In order to reduce the risk of accidental contact causing the battery module to detach from the housing, resulting in power interruption to the gun light, this application provides a gun light that is easy to replace with a battery.

The gun light that is easy to replace a battery provided in this application adopts the following technical solution.

A gun light that is easy to replace a battery, including a housing, a light-emitting module, a seat module, and a fixing mechanism; the housing is provided with a battery compartment that is penetrated through, and the battery compartment is slidably fitted with a battery module;

one side of the light-emitting module is rotatably connected to one end of the housing, and the other side of the light-emitting module is provided with a light-emitting locking groove; when the light-emitting module seals one end of the battery compartment, the light-emitting module is electrically connected to the battery module;

the seat module is connected to the other end of the housing; when the seat module seals the other end of the battery compartment, the seat module is electrically connected to the battery module;

the fixing mechanism includes a locking component, and the locking component includes a locking elastic sheet and a light-emitting locking rod; the locking elastic sheet is fixedly connected to the housing; when the locking component is locked, one end of the locking elastic sheet is clamped and fixed in the light-emitting locking groove; the light-emitting locking rod is rotatably provided on the housing and located at a bottom of the locking elastic sheet; the light-emitting locking rod includes a light-emitting plane and a light-emitting arc surface. When the light-emitting plane faces the locking elastic sheet, the locking component is locked, and when the light-emitting arc surface faces the locking elastic sheet, the locking component is unlocked.

By adopting the above technical solution, when the gun light needs to quickly replace a battery, the light-emitting locking rod is rotated, and a contact surface between the light-emitting locking rod and the locking elastic sheet is switched from the light-emitting plane to the light-emitting arc surface, so that the locking elastic sheet is gradually knocked up close to an end of the light-emitting module, thereby causing the locking elastic sheet to detach from a clamping fixation between the light-emitting locking groove, and releasing a lock between the light-emitting module and the housing, and the battery compartment is opened, thus completing a quick replacement of the battery in the battery compartment. Due to an elasticity of the locking elastic sheet, when the light-emitting locking rod is accidentally touched, the locking elastic sheet is less likely to knock up, thereby improving the problem of the gun light being easily touched by a user or debris during use, which can lead to a unlock of a connection between a battery holder and the housing, resulting in the battery holder slipping off, causing the power supply of the gun light to be interrupted, which affects a normal use of the gun light.

In some embodiments of the present application, the fixing mechanism further includes an adjusting component, and the adjusting component includes an adjusting slider and an adjusting rod, the adjusting slider is slidably fitted with the housing, the adjusting rod is provide on the adjusting slider, the adjusting rod is located at a top of the locking elastic sheet, the adjusting slider is slid in a direction close to or away from the light-emitting module, so that the adjusting rod is located at a top of different positions of the locking elastic sheet.

In some embodiments of the present application, the adjusting slider includes a first sliding part and a second sliding part, the housing is provided with a sliding groove that is penetrated along a length direction, the second sliding part is penetrated and is slidably fitted to the sliding groove, the adjusting rod is engraved with threads; the adjusting rod is penetrated through the first sliding part, and the adjusting rod is threaded connected to the second sliding part, so that when the adjusting rod is rotated, the second sliding part is moved towards or away from the first sliding part.

In some embodiments of the present application, a bottom of the first sliding part is engraved with a friction protrusion, and the housing is engraved with a friction recess, the friction protrusion and the friction recess are in contact and cooperate.

In some embodiments of the present application, one end of the seat module is rotatably connected to the housing, the other end of the seat module is provided with a seat locking groove, the other end of the locking elastic sheet is penetrated and fixed in the seat locking groove, the locking component further includes a seat locking rod, and the seat locking rod is rotatably provided on the housing and located at a bottom of the locking elastic sheet;

the seat locking rod includes a seat body plane and a seat body arc surface; when the seat body plane abuts against the locking elastic sheet, one end of the locking elastic sheet is clamped and fixed with the seat locking groove; when the seat locking rod is rotated and the seat body arc surface abuts against the locking elastic sheet, one end of the locking elastic sheet is disengaged, and is clamped and fixed with the seat locking groove.

In some embodiments of the present application, the fixing mechanism further includes a connecting component, and the connecting component includes a connecting rod, a connecting block, a connecting nut, and an adjusting handle, the connecting rod is provided on the housing, and the connecting rod is slid in a width direction, the connecting block is slidably fitted with the housing in the width direction, the connecting nut is threaded connected to one end of the connecting rod and abuts against the connecting block, and the adjusting handle is rotatably connected to the other end of the connecting rod.

In some embodiments of the present application, the connecting rod includes a first rod body and a second rod body, the first rod body is penetrated into an interior of the second rod body and is slidably fitted with the second rod body, the first rod body is fixedly connected with an adjusting protrusion, and an interior of the second rod body is fixedly provided with a plurality of contact protrusions, the contact protrusions are distributed along a length direction of the second rod body; the adjusting protrusion abut against the contact protrusions, and positions of the first rod body and the second rod body are relatively fixed.

In some embodiments of the present application, the connecting nut is fixedly provided with an easy-to-twist block.

In some embodiments of the present application, the contact protrusions are provided with a clamping groove, and when the adjusting protrusion is inserted into the clamping groove, the first rod body and the second rod body are not easily rotated relative to each other.

In some embodiments of the present application, the housing is provided with a limit position slot, and the limit position slot includes a first limit end and a second limit end, the first rod body is fixedly provided with a limit protrusion, the limit protrusion is penetrated and slidably fitted to the limit position slot, and when the limit protrusion is penetrated and slidably fitted with the first limit end, the adjusting protrusion is disengaged from the contact protrusions; when the limit protrusion is slid to the second limit end, the adjusting protrusion is rotated to align with the clamping groove.

In summary, this application includes at least one beneficial technical effect as follows.

When the gun light needs to quickly replace a battery, the light-emitting locking rod is rotated, and a contact surface between the light-emitting locking rod and the locking elastic sheet is switched from the light-emitting plane to the light-emitting arc surface, so that the locking elastic sheet is gradually knocked up close to an end of the light-emitting module, thereby causing the locking elastic sheet to detach from a clamping fixation between the light-emitting locking groove, and releasing a lock between the light-emitting module and the housing, and the battery compartment is opened, thus completing a quick replacement of the battery in the battery compartment. Due to an elasticity of the locking elastic sheet, when the light-emitting locking rod is accidentally touched, the locking elastic sheet is less likely to knock up, thereby improving the problem of the gun light being easily touched by a user or debris during use, which can lead to a unlock of a connection between a battery holder and the housing, resulting in the battery holder slipping off, causing the power supply of the gun light to be interrupted, which affects a normal use of the gun light.

Numeral reference: 1—housing; 11—battery compartment; 12—battery module; 13—sliding groove; 14—friction recess; 15—limit position slot; 151—first limit end; 152—second limit end; 2—light—emitting module; 21—light—emitting locking groove; 22—luminous sealing gasket; 3—seat module; 31—seat sealing gasket; 32—seat locking groove; 4—fixing mechanism; 41—locking component; 411—locking elastic sheet; 4111—fixing part; 4112—luminous locking part; 4113—seat locking part; 412—light—emitting locking rod; 4121—light—emitting plane; 4122—light—emitting arc surface; 413—light—emitting toggle; 414—seat locking rod; 415—seat toggle; 42—adjusting component; 421—adjusting slider; 4211—first sliding part; 42111—friction protrusion; 4212—second sliding part; 422—adjusting rod; 43—connecting component; 431—connecting rod; 4311—first rod body; 43111—adjusting protrusion; 43112—limit protrusion; 4312—second rod body; 43121—contact protrusion; 43122—clamping groove; 432—connecting block; 433—connecting nut; 4331—easy—to—twist block; 434—adjusting handle; 10—gun light; 20—firearms.

DESCRIPTION OF EMBODIMENTS

Further detailed explanation of the present application will be provided in combination with FIGS. 1-14.

An embodiment of the present application discloses a gun light that facilitates battery replacement.

Figure 1:
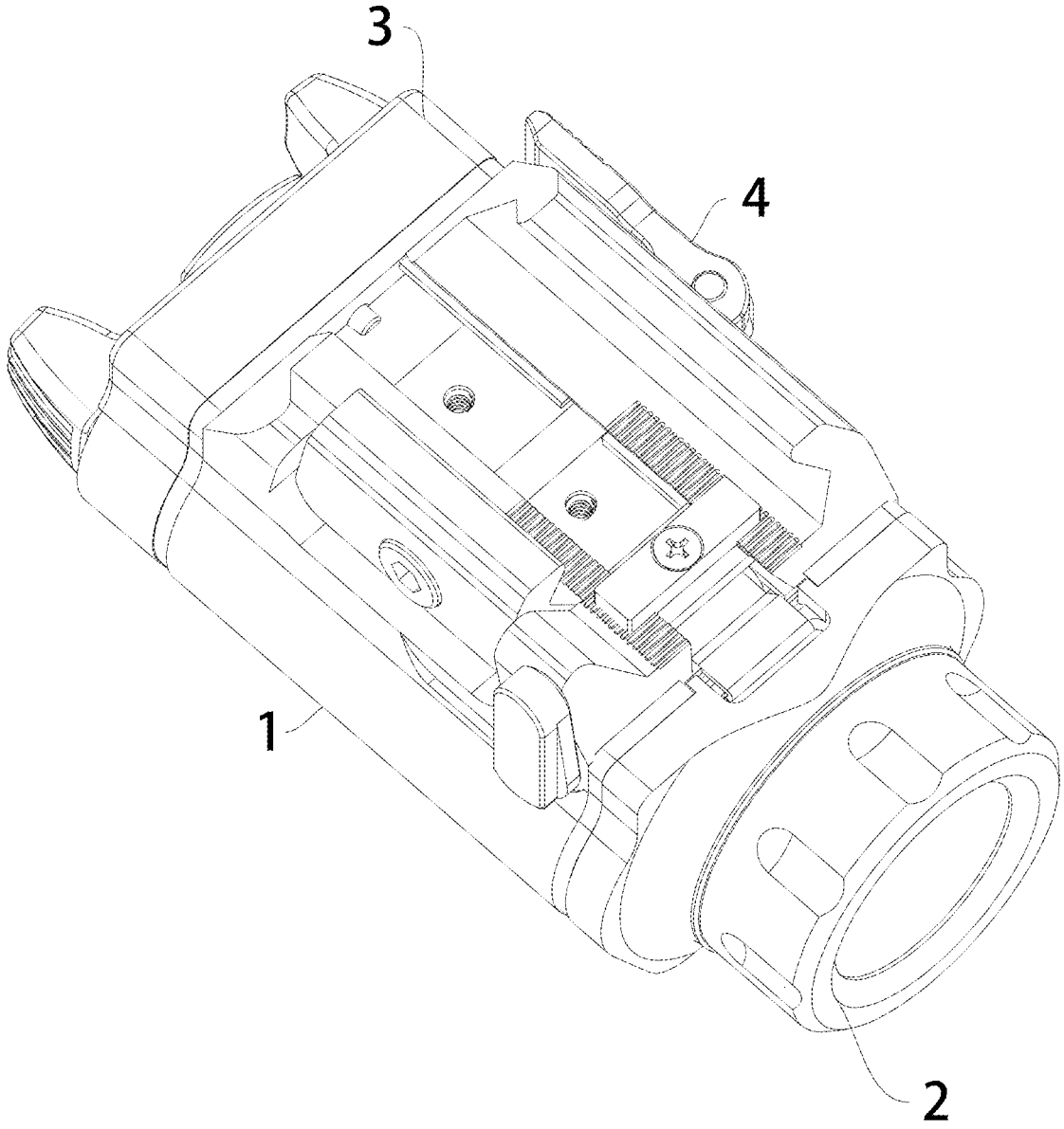
FIG. 1 is a schematic diagram of an overall structure of an embodiment.
Figure 2:
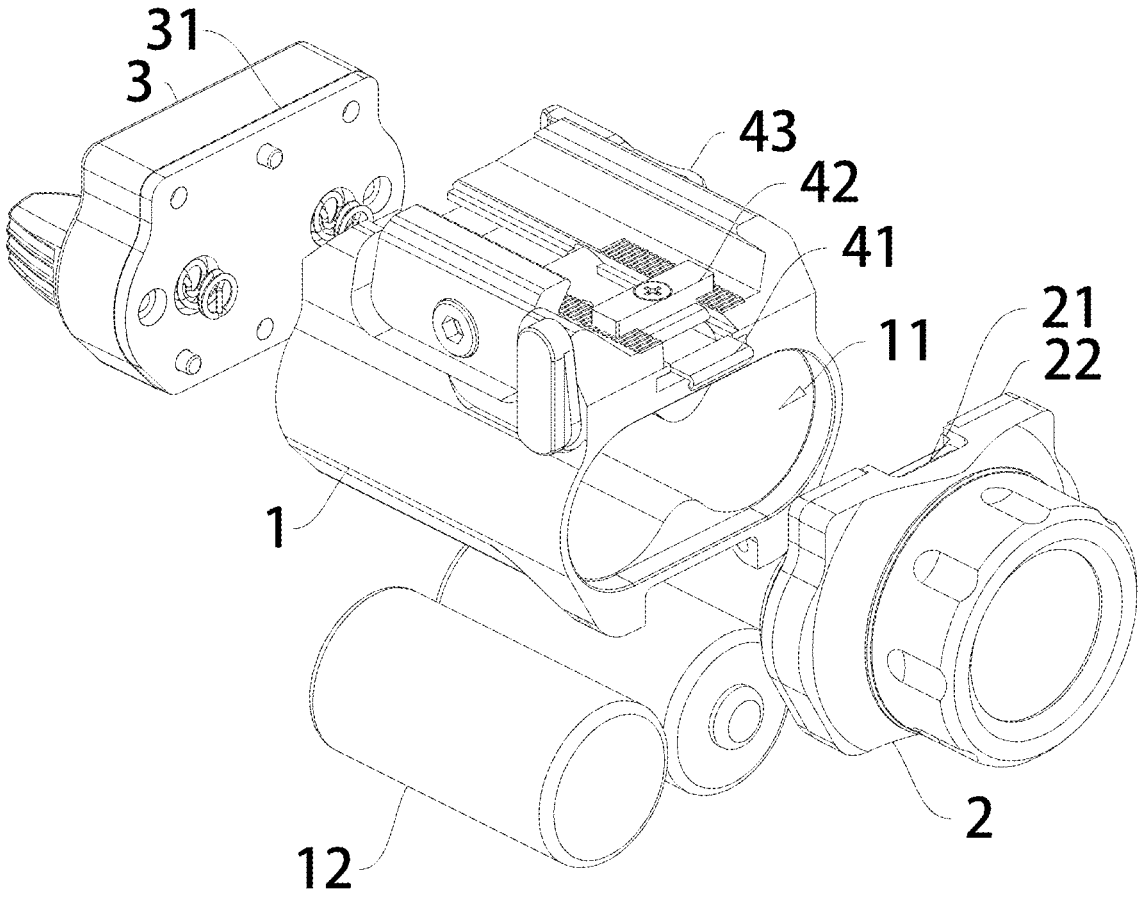
FIG. 2 is an exploded view of the overall structure of the embodiment.

Referring to FIGS. 1 and 2, a gun light that facilitates battery replacement includes a housing 1, a light-emitting module 2, a seat module 3, and a fixing mechanism 4. The housing 1 has a rectangular cross-section, and in this embodiment of the present application, a length direction of the housing 1 is the length direction, and a width direction of the housing 1 is the width direction. A battery compartment 11 is provided in the housing 1, and the battery compartment 11 is slidably fitted with a battery module 12.

Referring to FIGS. 1 and 2, one side of the light-emitting module 2 is rotatably connected to one end of the housing 1, and the other side of the light-emitting module 2 is provided with a light-emitting locking groove 21. When the light-emitting module 2 seals one end of the battery compartment 11, the light-emitting module 2 is electrically connected to the battery module 12. The light-emitting module 2 is configured for emission illumination of the gun light, and a luminous sealing gasket 22 is provided between the light-emitting module 2 and the housing 1. The luminous sealing gasket 22 is fixedly provided on the light-emitting module 2 and abuts against the housing 1, thereby improving a sealing between the light-emitting module 2 and the housing 1.

Referring to FIGS. 1 and 2, the seat module 3 is fixedly connected to the other end of the housing 1. When the seat module 3 seals the other end of the battery compartment 11, the seat module 3 is electrically connected to the battery module 12, thereby forming a closed loop between the light-emitting module 2 and the seat module 3, and completing the lighting function of the gun lamp. A seat sealing gasket 31 is provided between the seat module 3 and the housing 1, and the seat sealing gasket 31 is fixedly provided on the seat module 3 and abuts against the housing 1, thereby improving the sealing between the seat module 3 and the housing 1.

Referring to FIGS. 3, 4, 5, and 6, the fixing mechanism 4 includes a locking component 41. The locking component 41 includes a locking elastic sheet 411, a light-emitting locking rod 412, and a light-emitting toggle 413. The locking elastic sheet 411 includes a fixing part 4111 and a luminous locking part 4112. The luminous locking part 4112 is fixedly connected to one end of the fixing part 4111, and the fixing part 4111 is fixedly connected to a top of the housing 1 by a screw. When the locking component 41 is locked, the luminous locking part 4112 is penetrated, clamped and fixed in the light-emitting locking groove 21. The light-emitting locking rod 412 is rotatably provided in the housing 1 and located at a bottom of the locking elastic sheet 411. The light-emitting locking rod 412 includes a light-emitting plane 4121 and a light-emitting arc surface 4122. When the light-emitting plane 4121 faces the locking elastic sheet 411, the locking component 41 is locked; when the light-emitting arc surface 4122 faces the locking elastic sheet 411, the locking component 41 is unlocked. The light-emitting toggle 413 is fixedly provided at one end of the light-emitting locking rod 412, the light-emitting toggle 413 is rotated, and the light-emitting locking rod 412 is rotated.

Figure 3:
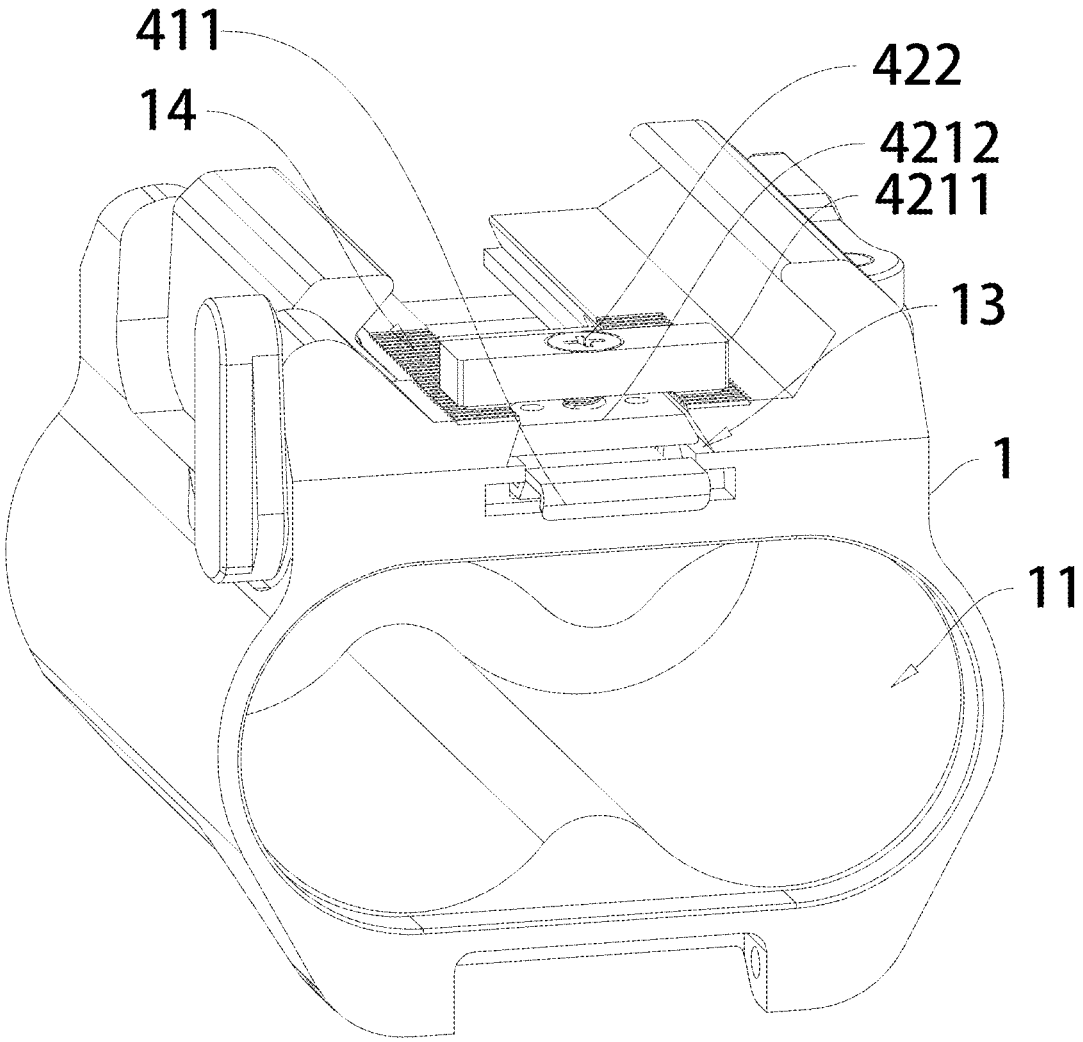
FIG. 3 is a schematic structural diagram of a housing of an embodiment.
Figure 4:
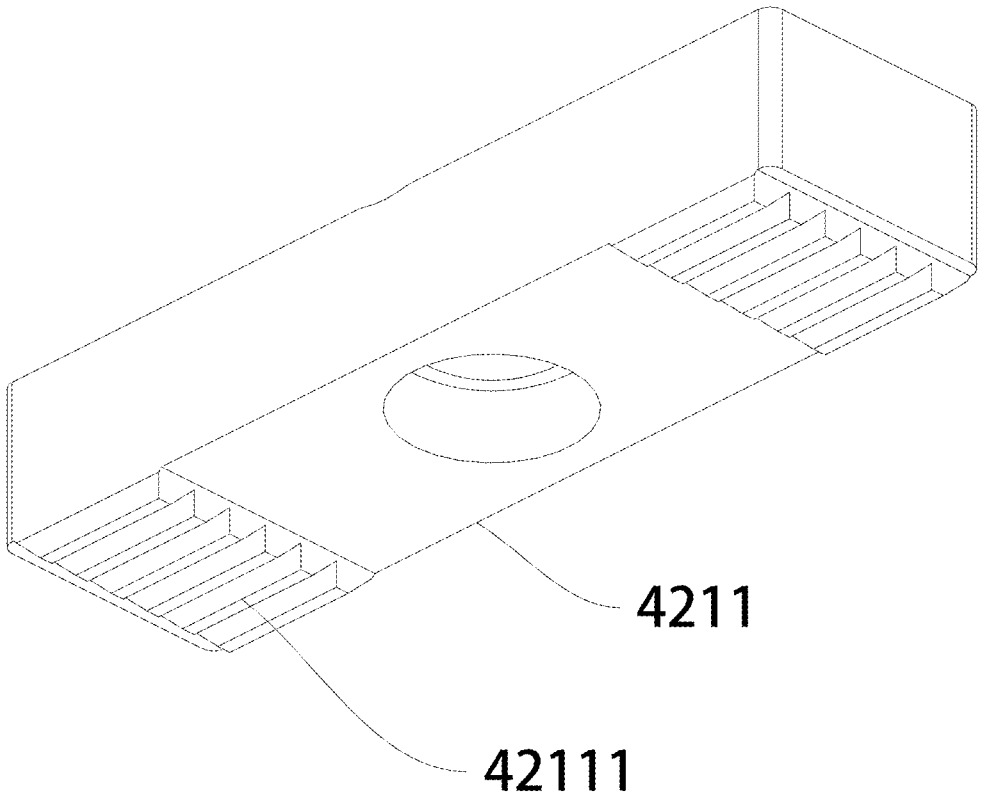
FIG. 4 is a schematic structural diagram of a first sliding part of an embodiment.
Figure 5:
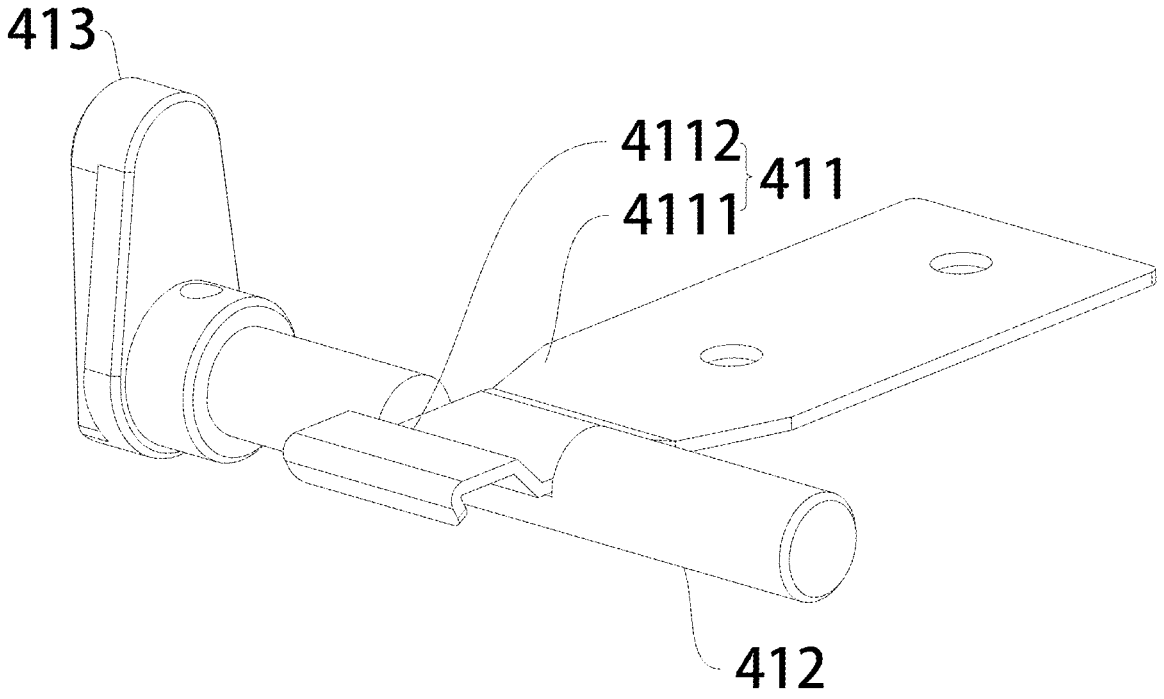
FIG. 5 is a first schematic structural diagram of a locking component in an embodiment.
Figure 6:
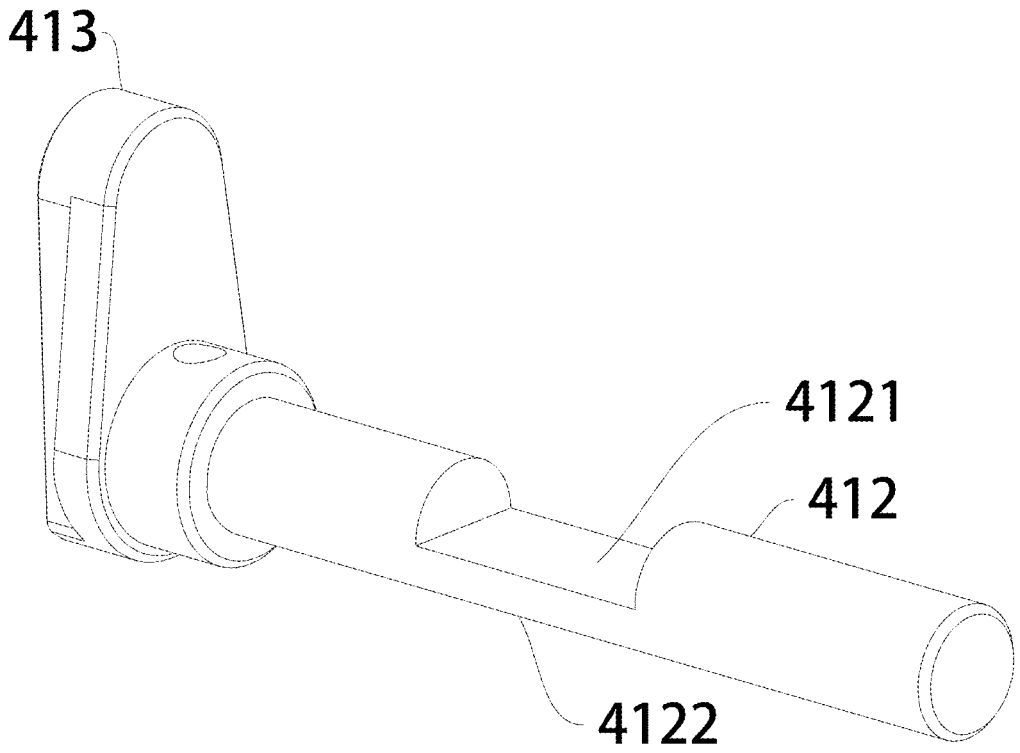
FIG. 6 is a second schematic structural diagram of the locking component in an embodiment.

Referring to FIGS. 3, 4, and 5, the fixing mechanism 4 further includes an adjusting component 42, and the adjusting component 42 includes an adjusting slider 421 and an adjusting rod 422. The adjusting slider 421 includes a first sliding part 4211 and a second sliding part 4212. A sliding groove 13 is provided at the top of the housing 1 along the length direction, and the first sliding part 4211 abuts against the top of the housing 1. The second sliding part 4212 is penetrated and is slidably fitted to the sliding groove 13, so that the adjusting slider 421 is slidably fitted to the top of the housing 1. The adjusting rod 422 is engraved with threads, and the adjusting rod 422 is penetrated through the first sliding part 4211. The adjusting rod 422 is threaded connected to the second sliding part 4212.

When the adjusting rod 422 is rotated, the second sliding part 4212 is moved towards or away from the first sliding part 4211, thereby adjusting the tightness of a contact fit between the first sliding part 4211 and the housing 1. This renders it easier to adjust the adjusting slider 421 along the length direction of the housing 1 by adjusting a distance between the first sliding part 4211 and the second sliding part 4212.

Referring to FIGS. 3 and 4, a bottom of the first sliding part 4211 is engraved with a friction protrusion 42111, and the housing 1 is engraved with a friction recess 14. The friction protrusion 42111 and the friction recess 14 are in contact and cooperate, thereby increasing a frictional resistance between the first sliding part 4211 and the top of the housing 1. When the positions of the first sliding part 4211 and the second sliding part 4212 are close to each other to a certain extent, a relative position between the adjusting slider 421 and the housing 1 is not easily changed.

Besides that, the adjusting rod 422 is located at a top of the locking elastic sheet 411, so that when the adjusting slider 421 is slid along the length direction of the housing 1, the adjusting rod 422 is slid in a direction close to or away from the light-emitting module 2 along the length direction. By adjusting the adjusting rod 422 at different positions on the top of the locking elastic sheet 411, the locking elastic sheet 411 can be adjusted when the light-emitting locking rod 412 pushes the locking elastic sheet 411 to knock it off. When the adjusting rod 422 is moved to contact with the locking elastic sheet 411, the light-emitting locking rod 412 is less likely to push the locking elastic sheet 411 to knock it off, rendering it difficult to unlock the lock between the housing 1 and the light-emitting module 2.

Figure 7:
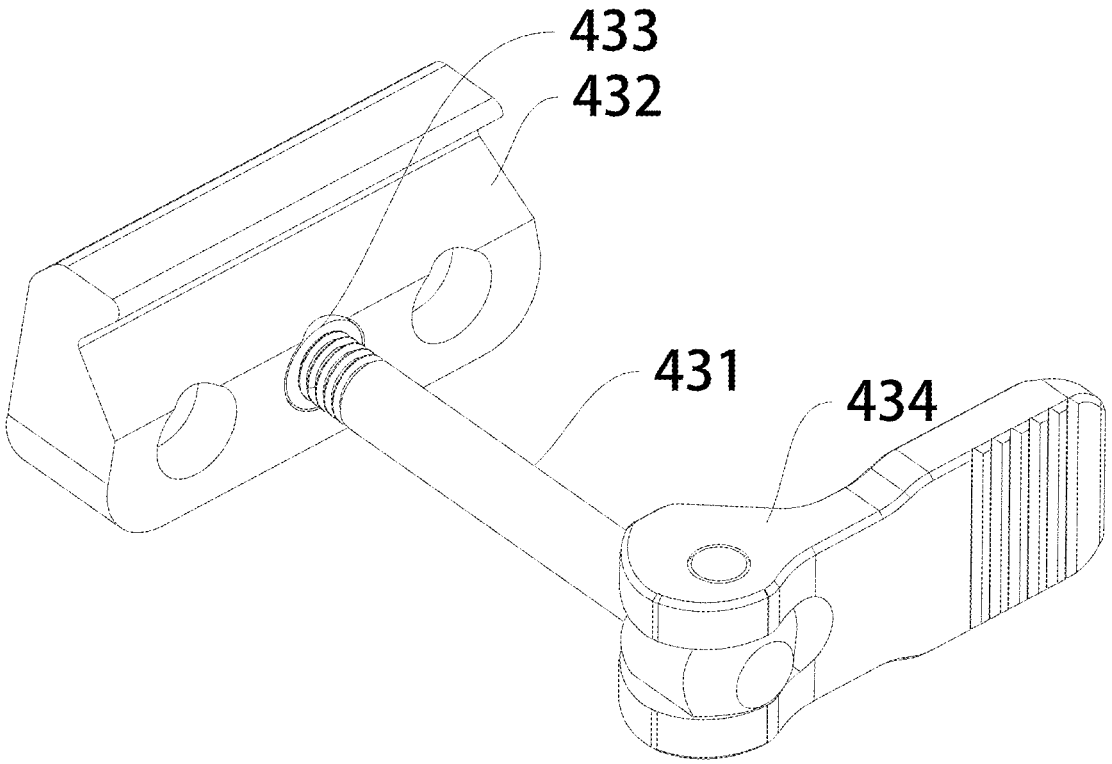
FIG. 7 is a schematic structural diagram of a connecting component in an embodiment.

Referring to FIG. 7, the fixing mechanism 4 further includes a connecting component 43, and the connecting component 43 includes a connecting rod 431, a connecting block 432, a connecting nut 433, and an adjusting handle 434. The connecting rod 431 is provided on the housing 1 and can slide along the width direction of the housing 1. The connecting block 432 is slidably fitted with the housing 1 along the width direction. The connecting nut 433 is threaded connected to one end of the connecting rod 431 and abuts against the connecting block 432. The adjusting handle 434 is rotatably connected to the other end of the connecting rod 431.

When the gun light 10 is installed on a firearm 20, the connecting block 432 abuts against one side of the firearm, and the housing 1 abuts against the other side of the firearm. The adjusting handle 434 is rotated towards a direction close to the housing 1, so that the connecting rod 431 is slid in the width direction, which drives the connecting block 432 to slide towards the housing 1 in the width direction, so that the connecting block 432 and the housing 1 are tightly fixed to two sides of the firearm 20, thereby enabling the gun light 10 to be quickly installed on the firearm 20.

The implementation principle of this gun light is: when the gun light needs to quickly replace a battery, the light-emitting locking rod 412 is rotated, and a contact surface between the light-emitting locking rod 412 and the locking elastic sheet 411 is switched from the light-emitting plane 4121 to the light-emitting arc surface 4122, so that the locking elastic sheet 411 is gradually knocked up close to an end of the light-emitting module 2, thereby causing the locking elastic sheet 411 to detach from a clamping fixation between the light-emitting locking groove 21, and releasing a lock between the light-emitting module 2 and the housing 1, and the battery compartment 11 is opened, thus completing a quick replacement of the battery in the battery compartment 11. Due to an elasticity of the locking elastic sheet 411, when the light-emitting locking rod 412 is accidentally touched, the locking elastic sheet 411 is less likely to knock up, thereby improving the problem of the gun light being easily touched by a user or debris during use, which can lead to a unlock of a connection between a battery holder and the housing, resulting in the battery holder slipping off, causing the power supply of the gun light to be interrupted, which affects a normal use of the gun light.

Figure 8:
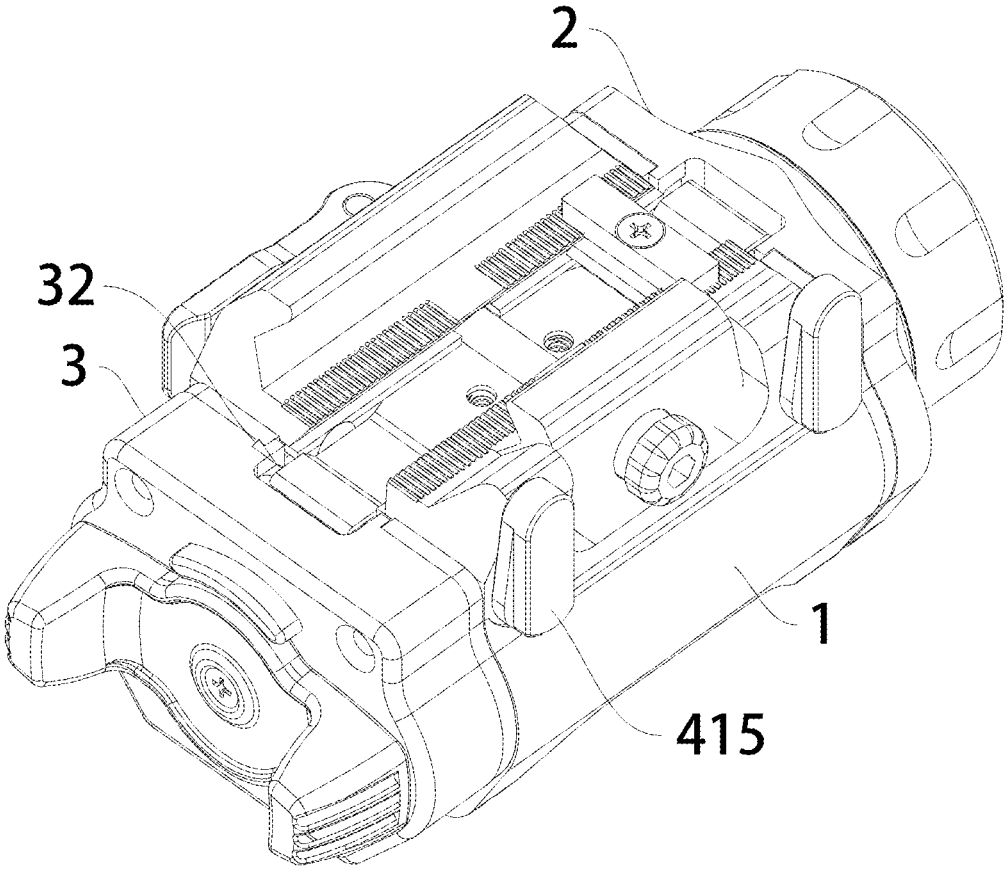
FIG. 8 is a second schematic diagram of the overall structure in an embodiment.
Figure 9:
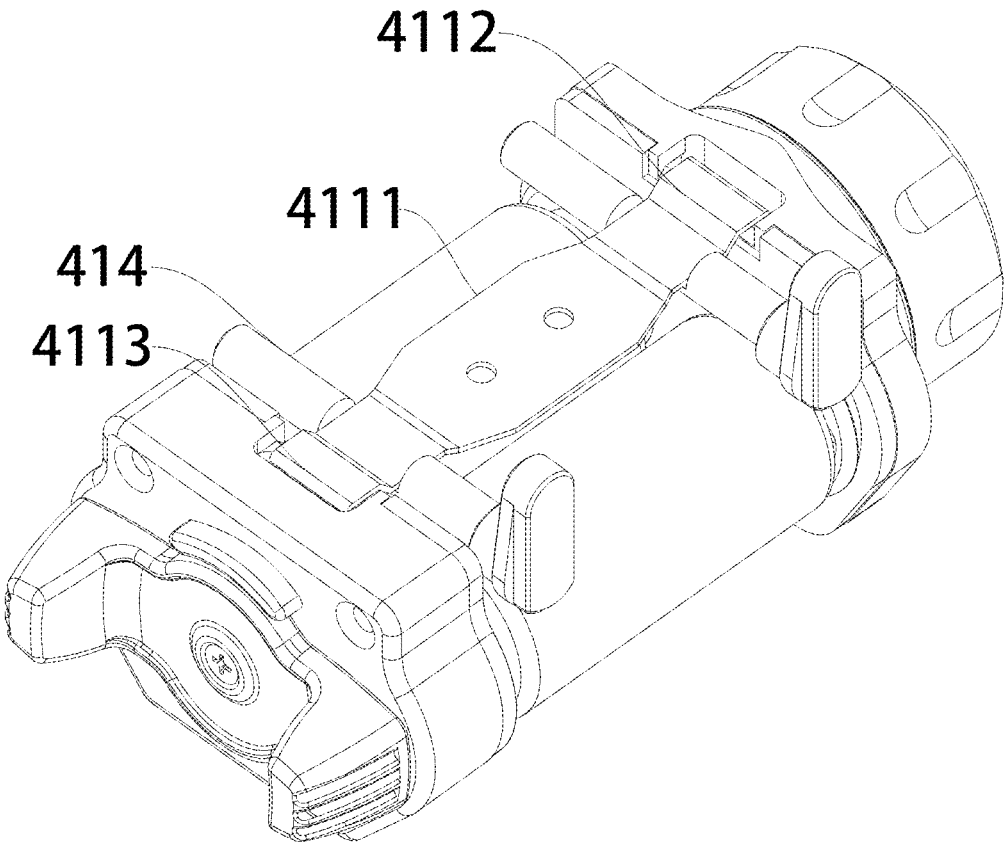
FIG. 9 is a second schematic structural diagram of the locking component in an embodiment.

Referring to FIGS. 8 and 9, one side of the seat module 3 is rotatably connected to the other end of the housing 1, and the other side of the seat module 3 is provided with a seat locking groove 32. The locking elastic sheet 411 further includes a seat locking part 4113, and the seat locking part 4113 is fixedly connected to one end of the fixing part 4111 away from the luminous locking part 4112. The seat locking part 4113 is penetrated, clamped and fixed in the seat locking groove 32.

The locking component 41 further includes a seat locking rod 414 and a seat toggle 415. The seat locking rod 414 is rotatably provided on the housing 1 and located at the bottom of the locking elastic sheet 411. The seat locking rod 414 includes a seat plane and a seat arc surface. When the seat plane abuts against the locking elastic sheet 411, the seat locking part 4113 is clamped and fixed with the seat locking groove 32. When the seat locking rod 414 is rotated and the seat arc surface abuts against the locking elastic sheet 411, the seat locking part 4113 is disengaged from, and is clamped and the fixed with the seat locking groove 32, thereby enabling the battery compartment 11 to be opened both forward and backward, rendering the opening and battery replacement of the battery compartment 11 more diversified. Thus, the gun light is more suitable for the battery replacement needs in different usage environments.

Figure 10:
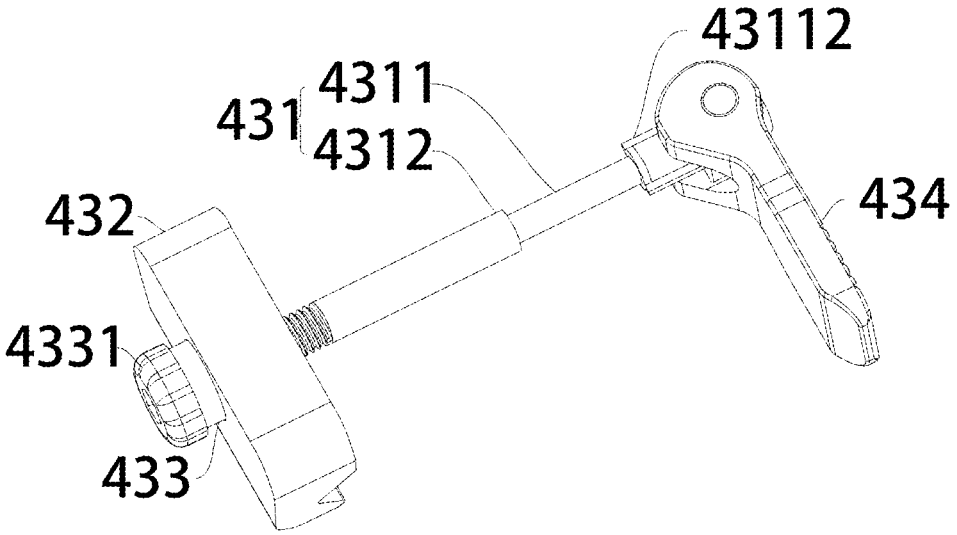
FIG. 10 is a second schematic structural diagram of the connection component in an embodiment.
Figure 11:
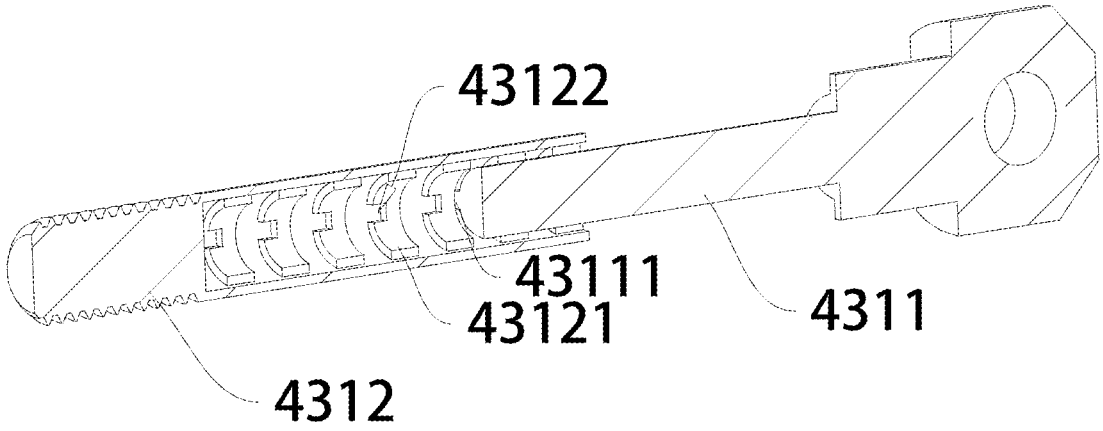
FIG. 11 is a sectional view of a connecting rod in an embodiment.

Referring to FIGS. 10 and 11, the connecting rod 431 includes a first rod body 4311 and a second rod body 4312. The first rod body 4311 is penetrated with an interior of the second rod body 4312 and is slidably fitted with the second rod body 4312. One end of the first rod body 4311 away from the second rod body 4312 is rotatably connected to the adjusting handle 434, and one end of the second rod body 4312 away from the first rod body 4311 is connected to the connecting block 432. One end of the first rod body 4311 close to the second rod body 4312 is fixedly connected to the adjusting protrusion 43111, and an interior of the second rod body 4312 is fixedly provided with a plurality of contact protrusions 43121. The contact protrusions 43121 are evenly distributed along a length direction of the second rod body 4312. The adjusting protrusion 43111 abuts against any one of the contact protrusions 43121, and positions of the first rod body 4311 and the second rod body 4312 are relatively fixed. At this time, the first rod body 4311 and the second rod body 4312 are not easily slid in the direction of close to or far away.

The first rod body 4311 and the second rod body 4312 can slide relative to each other, so that when the gun light needs to be fixed on firearms 20 of different sizes and models, the first rod body 4311 and the second rod body 4312 can slide in a direction of approaching or moving away from each other, so that a length of the connecting rod 431 can be enlarged or shortened along with a sliding edge length between the first rod body 4311 and the second rod body 4312, rendering the gun light 10 more suitable for installation on firearms 20 of different sizes and models.

Figure 12:
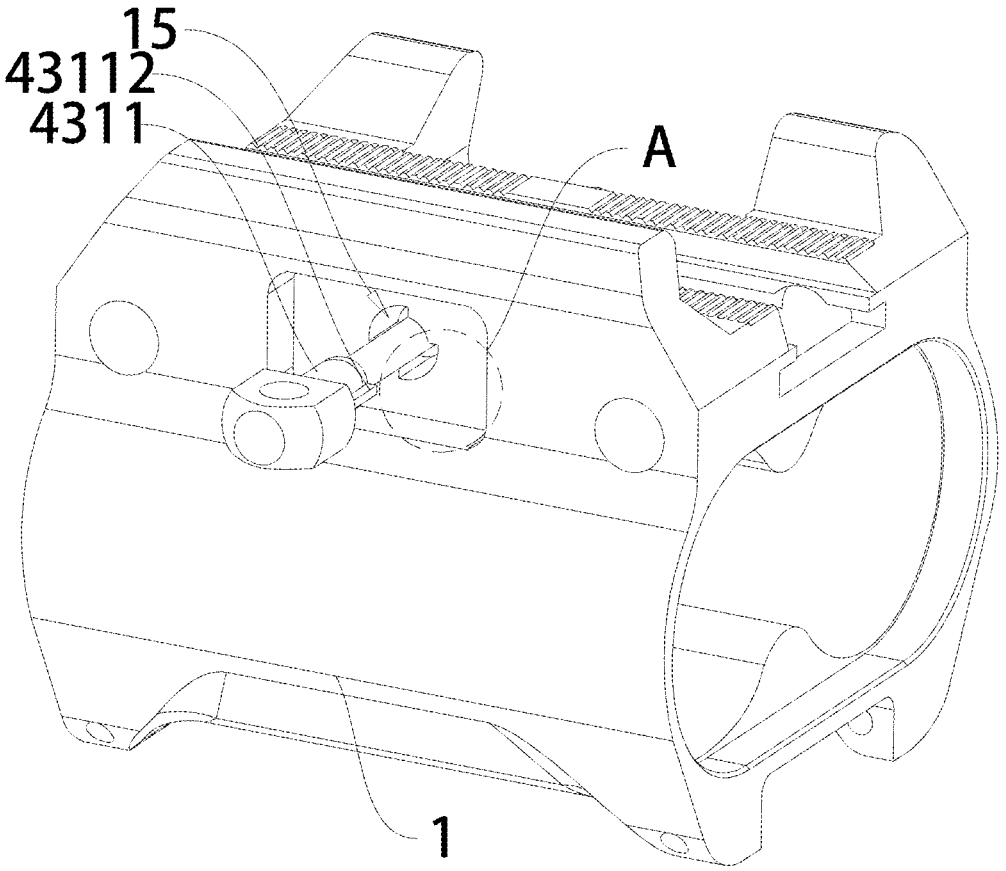
FIG. 12 is a schematic structural diagram of a limit position slot in an embodiment.
Figure 13:
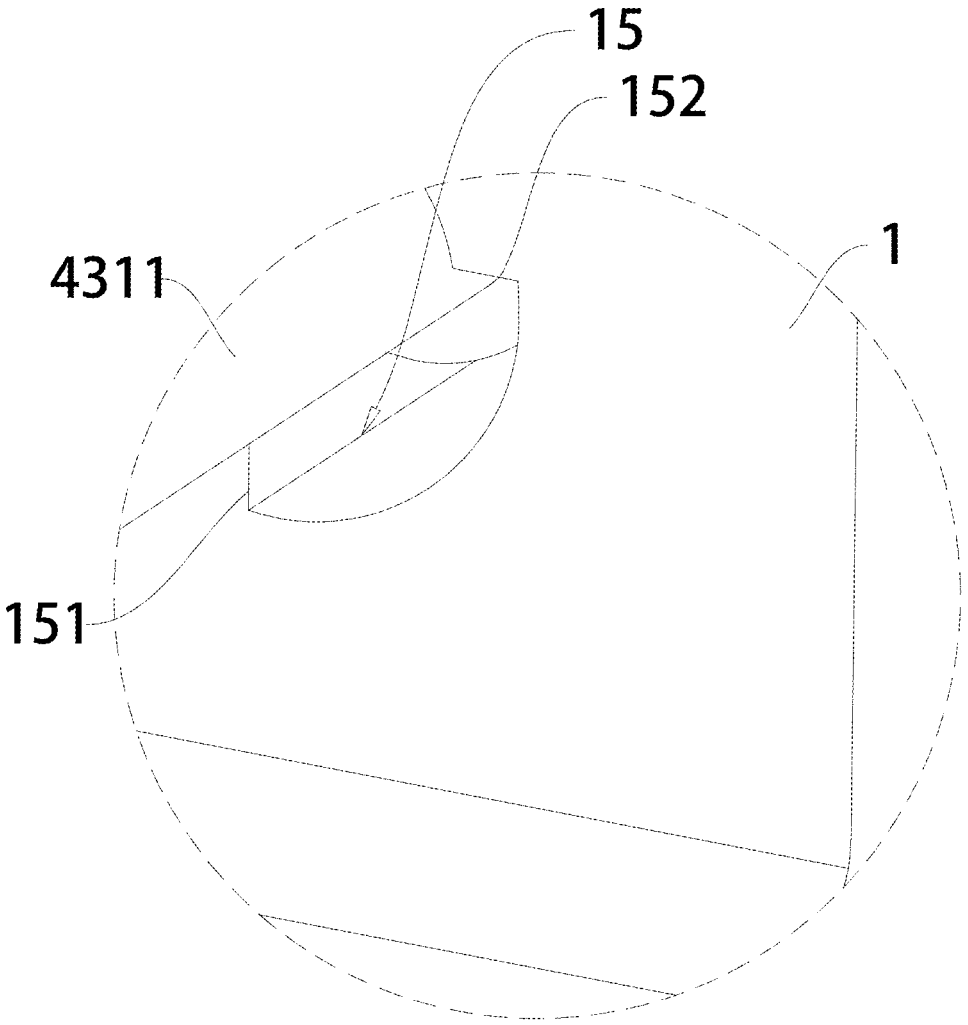
FIG. 13 is an enlarged view of part A of FIG. 12.

Referring to FIGS. 11, 12, and 13, the contact protrusions 43121 are provided with a clamping groove 43122. When the adjusting protrusion 43111 is penetrated the clamping groove 43122, the first rod body 4311 and the second rod body 4312 are not easily rotated relative to each other. The housing 1 is provided with a limit position slot 15, and the limit position slot 15 includes a first limit end 151 and a second limit end 152. The first rod body 4311 is fixedly provided with a limit protrusion 43112, and the limit protrusion 43112 is penetrated and slidably fitted with the limit position slot 15. When the limit protrusion 43112 is slid to the first limit end 151, an adjusting protrusion 43111 is disengaged from the contact with the contact protrusions 43121. When limit protrusion 43112 is slid to the second limit end 152, the adjusting protrusion 43111 is rotated to align with the clamping groove 43122.

Figure 14:
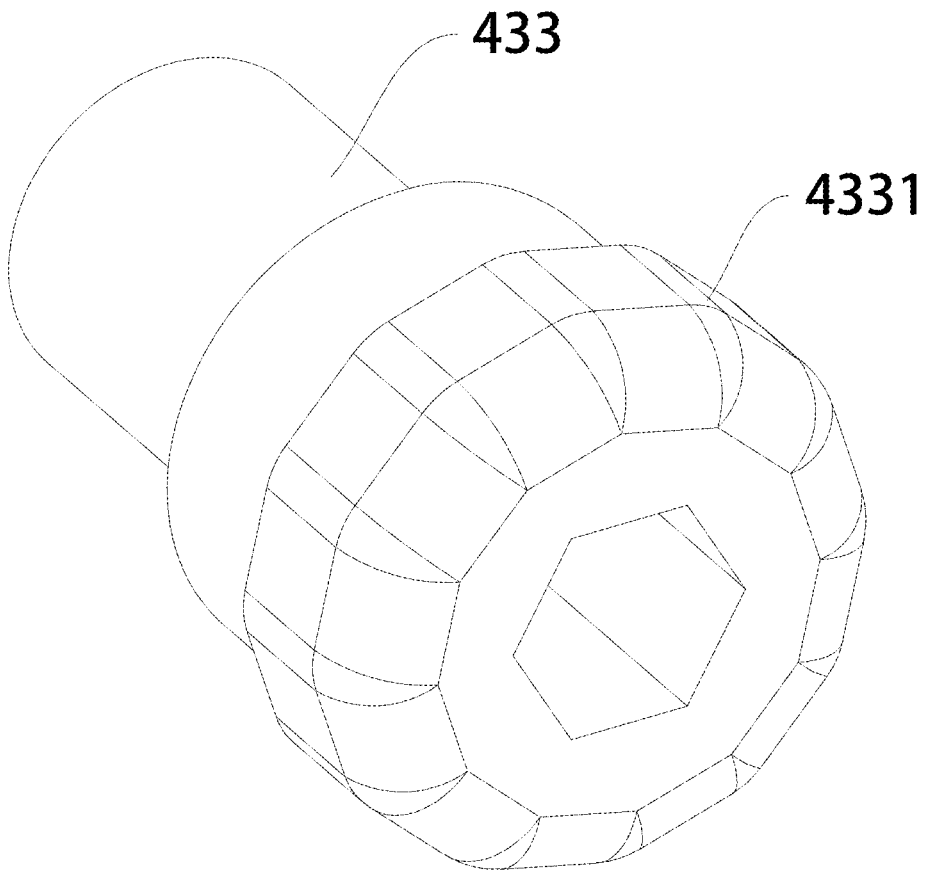
FIG. 14 is a schematic structural diagram of a connecting nut in an embodiment.
Figure 15:
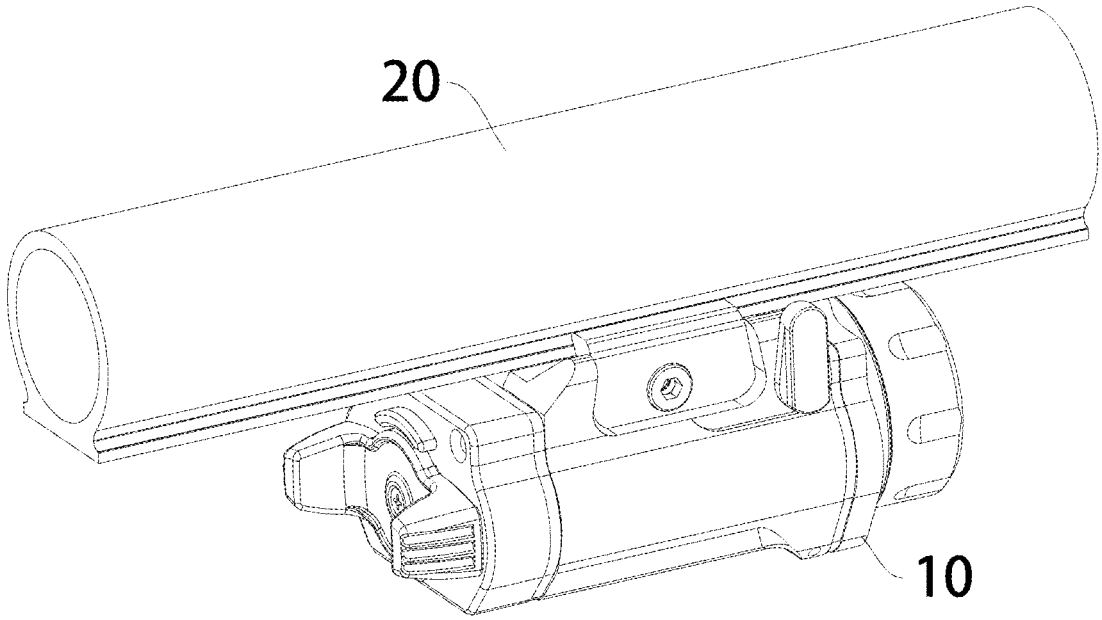
FIG. 15 is an installation schematic diagram of a technical solution of the present application.

Referring to FIG. 14, an easy-to-twist block 4331 is fixedly provided at one end of the connecting nut 433 away from the connecting block 432. The setting of the easy-to-twist block 4331 enables a gradual adjustment of a width direction distance between the connecting block 432 and the housing 1 after the first rod body 4311 and the second rod body 4312 are sliding relative to each other. By turning the easy-to-twist block 4331, the connecting block 432 is slid in the width direction towards or away from the housing 1, thereby achieving seamless and precise adjustment of the width direction distance between the connecting block 432 and the housing 1, rendering the gun more suitable for installation in firearms of different sizes and models.

The above are preferred embodiments of the present application and do not limit the protection scope of the present application. Therefore, any equivalent changes made according to the structure, shape, and principle of the present application should be included in the protection scope of the present application.

What is claimed is:

1. A gun light that is easy to replace a battery, comprising a housing, a light-emitting module, a seat module, and a fixing mechanism;

the housing is provided with a battery compartment that is penetrated through, and the battery compartment is slidably fitted with a battery module;

one side of the light-emitting module is rotatably connected to one end of the housing, and the other side of the light-emitting module is provided with a light-emitting locking groove; when the light-emitting module seals one end of the battery compartment, the light-emitting module is electrically connected to the battery module;

the seat module is connected to the other end of the housing; when the seat module seals the other end of the battery compartment, the seat module is electrically connected to the battery module;

the fixing mechanism comprises a locking component, and the locking component comprises a locking elastic sheet and a light-emitting locking rod; the locking elastic sheet is fixedly connected to the housing;

when the locking component is locked, one end of the locking elastic sheet is clamped and fixed in the light-emitting locking groove;

the light-emitting locking rod is rotatably provided on the housing and located at a bottom of the locking elastic sheet;

the light-emitting locking rod comprises a light-emitting plane and a light-emitting arc surface.

2. The gun light according to claim 1, wherein the fixing mechanism further comprises an adjusting component, and the adjusting component comprises an adjusting slider and an adjusting rod, the adjusting slider is slidably fitted with the housing, the adjusting rod is provide on the adjusting slider, the adjusting rod is located at a top of the locking elastic sheet, the adjusting slider is slid in a direction close to or away from the light-emitting module, so that the adjusting rod is located at a top of different positions of the locking elastic sheet.

3. The gun light according to claim 2, wherein the adjusting slider comprises a first sliding part and a second sliding part, the housing is provided with a sliding groove that is penetrated along a length direction, the second sliding part is penetrated and is slidably fitted to the sliding groove, the adjusting rod is engraved with threads;

the adjusting rod is penetrated through the first sliding part, and the adjusting rod is threaded connected to the second sliding part, so that when the adjusting rod is rotated, the second sliding part is moved towards or away from the first sliding part.

4. The gun light according to claim 3, wherein a bottom of the first sliding part is engraved with a friction protrusion, and the housing is engraved with a friction recess, the friction protrusion and the friction recess are in contact and cooperate.

5. The gun light according to claim 1, wherein one end of the seat module is rotatably connected to the housing, the other end of the seat module is provided with a seat locking groove, the other end of the locking elastic sheet is penetrated and fixed in the seat locking groove, the locking component further comprises a seat locking rod, and the seat locking rod is rotatably provided on the housing and located at a bottom of the locking elastic sheet;

the seat locking rod comprises a seat body plane and a seat body arc surface;

when the seat body plane abuts against the locking elastic sheet, one end of the locking elastic sheet is clamped and fixed with the seat locking groove;

when the seat locking rod is rotated and the seat body arc surface abuts against the locking elastic sheet, one end of the locking elastic sheet is disengaged, and is clamped and fixed with the seat locking groove.

6. The gun light according to claim 1, wherein the fixing mechanism further comprises a connecting component, and the connecting component comprises a connecting rod, a connecting block, a connecting nut, and an adjusting handle, the connecting rod is provided on the housing, and the connecting rod is slid in a width direction, the connecting block is slidably fitted with the housing in the width direction, the connecting nut is threaded connected to one end of the connecting rod and abuts against the connecting block, and the adjusting handle is rotatably connected to the other end of the connecting rod.

7. The gun light according to claim 6, wherein the connecting rod comprises a first rod body and a second rod body, the first rod body is penetrated into an interior of the second rod body and is slidably fitted with the second rod body, the first rod body is fixedly connected with an adjusting protrusion, and an interior of the second rod body is fixedly provided with a plurality of contact protrusions, the contact protrusions are distributed along a length direction of the second rod body;

the adjusting protrusion abut against the contact protrusions, and positions of the first rod body and the second rod body are relatively fixed.

8. The gun light according to claim 7, wherein the connecting nut is fixedly provided with an easy-to-twist block.

9. The gun light according to claim 6, wherein the contact protrusions are provided with a clamping groove, and when the adjusting protrusion is inserted into the clamping groove, the first rod body and the second rod body are not easily rotated relative to each other.

10. The gun light according to claim 9, wherein the housing is provided with a limit position slot, and the limit position slot comprises a first limit end and a second limit end, the first rod body is fixedly provided with a limit protrusion, the limit protrusion is penetrated and slidably fitted to the limit position slot, and when the limit protrusion is penetrated and slidably fitted with the first limit end, the adjusting protrusion is disengaged from the contact protrusions;

when the limit protrusion is slid to the second limit end, the adjusting protrusion is rotated to align with the clamping groove.

* * * * *